US005474210A

United States Patent [19]

Boyd

[11] Patent Number: 5,474,210

[45] Date of Patent: Dec. 12, 1995

[54] FLUID DISPENSING DEVICE

[75] Inventor: Secil E. Boyd, Springfield, Mo.

[73] Assignee: Pump Products, Inc., Springfield, Mo.

[21] Appl. No.: 152,921

[22] Filed: Nov. 16, 1993

Related U.S. Application Data

[63] Continuation of Ser. No. 842,563, Feb. 27, 1992, abandoned.

[51] Int. Cl.[6] ..... B65D 83/14

[52] U.S. Cl. ..... 222/1; 222/401; 222/192

[58] Field of Search ..... 222/1, 401, 394, 222/400.8, 402, 402.1, 192

[56] References Cited

U.S. PATENT DOCUMENTS

| | | | |
|---|---|---|---|
| 162,888 | 5/1875 | Bingham | 222/401 X |
| 718,163 | 1/1903 | Sherrard | 222/401 X |
| 1,051,554 | 1/1913 | Champion | 222/401 X |
| 1,708,340 | 4/1929 | Tanner | 222/401 |
| 2,090,977 | 8/1937 | Hoffman | 222/401 X |
| 2,211,823 | 8/1940 | Jepson | 222/401 |
| 2,509,369 | 5/1950 | Robertson . | |
| 2,653,848 | 9/1953 | Lee | 222/401 X |
| 2,691,548 | 10/1954 | Feucht et al. . | |
| 3,061,202 | 10/1962 | Tyler | 239/333 |
| 3,120,347 | 2/1964 | Duke . | |
| 3,650,473 | 3/1972 | Malone . | |
| 3,710,989 | 1/1973 | Armour . | |
| 3,823,718 | 7/1974 | Tromovitch | 222/401 X |
| 4,077,442 | 3/1978 | Olofsson . | |
| 4,147,284 | 4/1979 | Mizzi | 222/401 |
| 4,523,699 | 6/1985 | Branscum . | |
| 4,537,334 | 8/1985 | Spengler et al. | 222/401 |
| 4,763,803 | 8/1988 | Schneider . | |
| 4,779,683 | 10/1988 | Enk . | |
| 4,815,663 | 3/1989 | Tada . | |
| 4,830,231 | 5/1989 | Smith . | |
| 4,875,626 | 10/1989 | Buhler et al. . | |
| 4,899,896 | 2/1990 | Metzger . | |
| 5,010,928 | 5/1991 | Ballas | 222/401 X |

FOREIGN PATENT DOCUMENTS

| | | | |
|---|---|---|---|
| 3540984 | 5/1987 | Germany | 222/401 |
| 250 | of 1886 | United Kingdom | 222/401 |

*Primary Examiner*—Andres Kashnikow
*Assistant Examiner*—Kenneth Bomberg
*Attorney, Agent, or Firm*—Kircher, Bowman & Johnson Kokjer

[57] ABSTRACT

A liquid spray device for mounting on a liquid container. The device comprises a spray member mountable over the opening of a container as a closure and a pump configured to pump air into the spray member and container. A discharge system including a discharge nozzle is selectively operable to discharge pressurized liquid from the spray member through the nozzle.

26 Claims, 4 Drawing Sheets

FLUID DISPENSING DEVICE

This is a continuation in part of application Ser. No. 07/824,563, filed Feb. 27, 1992, now abandoned.

BACKGROUND AND SUMMARY OF THE INVENTION

The present invention relates to a fluid dispensing device for mounting on an open container and more particularly relates to an improved liquid spray device that is useful for expelling highly pressurized liquids from a disposable container.

Conventional liquid dispensing or spraying devices commonly utilize a pump mechanism to effectively transfer the liquid from a containment region to a spray nozzle outlet. The pump mechanism may be part of a screw-on closure for the container that can be removed to refill the container or may be incorporated as a permanent part of the container body, such as in conventional water guns, for example.

Many of these spraying devices comprise a manually operable trigger that actuates a reciprocating piston within a pumping chamber in the sprayer. When the trigger is squeezed, the piston is forced inwardly of the pump chamber, expelling any air or liquid from the chamber and through the spray nozzle. When the trigger is released, a return spring will bias the piston back to an outward position thereby drawing liquid into the evacuated chamber from the liquid containment region. Examples of these type devices are disclosed in U.S. Pat. No. 3,061,202 to Tyler and U.S. Pat. No. 3,650,473 to Malone.

Although these spray pump dispensers are useful for distributing fluid within the immediate area, the pressure exerted by the trigger induced piston within the pump chamber is not sufficient to provide a highly pressurized spray. Thus, the dispensers are not capable of forcefully dispensing fluids a relatively far distance, such as is desired for use as a water gun. Furthermore, the pressure is insufficient to dispense the fluid through a hose, as may be desired for watering plants, for example.

There are other types of pump sprayers that dispense fluid under relatively higher pressure conditions. However these devices are usually bulky or otherwise inconvenient. For example, electrical pump sprayers such as electrical paint guns, provide a highly pressurized spray. However the user must have access to electricity and his or her movement, activities and location are thus significantly limited. Other sprayers, such as conventional pesticide sprayers, utilize a pump to initially build up air pressure in the container and then dispense the pressurized fluid through a sprayer hose. Although these sprayers have utility for job specific activities, they are usually bulky due to the presence of a permanent pump attachment and a separate dispenser hose. Furthermore, the dispenser components are integrated or specially adapted for attachment with the container body. Thus, if the container body is broken or contaminated for purposes of dispensing a different fluid product, a whole new sprayer is required.

In view of these problems, it is a primary object of the present invention to provide an improved liquid spray device that is capable of dispensing highly pressurized liquids.

It is another object of the present invention to provide a liquid spray device that is conveniently adapted for use with readily available disposable containers.

A further object of the present invention is to provide a liquid spray device that is relatively compact and is convenient to carry and use.

Yet another object of the present invention is to provide a liquid spray device that comprises a pump and a spray member, wherein the pump is detachable from the spray member for ease of use.

A further object of the present invention is to provide a liquid dispensing device that can be utilized in conjunction with a hose to deliver the liquid.

It is another object of the present invention to provide a powerful water gun that delivers pressurized liquid a relatively far distance.

Another object of the present invention is to provide an air dispensing device that is conveniently adapted for use with readily available and disposable containers.

A related object of the present invention is to provide an air horn.

It is also a further object of the present invention to provide a fluid dispensing device that is relatively inexpensive, compact and easy to carry, adapted for use with readily available containers, and suitable for a variety of uses.

These and other objects of the present invention are achieved by an improved liquid spray device for mounting on an open topped liquid container. The device generally comprises a spray member mountable over the container opening as a closure and an air pump configured to pump air into the spray member and container. After pressurizing the container in this manner, the liquid contained therein is transferred to a liquid receiving chamber provided in the spray member. A discharge means including a discharge nozzle is selectively operable to discharge the pressurized liquid from the chamber through the nozzle. The pressurized liquid travels a relatively long distance in a continuous stream and with considerable force when it is dispensed from the container in this manner.

In one embodiment, the air pump and the spray member are provided as separate components. The spray member includes an inner fluid receiving chamber having an open bottom which communicates with the container on which it is mounted. The air pump having an exhaust port is complimentally configured to fit over an inlet port provided in the spray member so that air exiting the exhaust port may pass through the inlet port into the fluid receiving chamber. A means, such as a flapper valve, is provided in the inlet port to block the outward flow of fluids, while permitting the inward flow of air from the pump. After pressurizing the container, the pump is removed from the spray member and the container is inverted to transfer the liquid into the receiving chamber. A discharge nozzle is connected via a passageway to the spray member receiving chamber. This passageway can be selectively opened to discharge the pressurized liquid in the chamber through the nozzle.

Another embodiment of the present invention includes a liquid spray device comprising an air pump and spray member that are compactly integrated to form a single component.

A further embodiment of the present invention includes a transfer tube extending from the fluid receiving chamber in the spray member to the liquid container. The transfer tube is provided as a means for conveying pressurized liquid in the container to the receiving chamber, without requiring the container to be inverted.

Other embodiments include a spraying or misting component for mounting over the sprayer discharge nozzle to vary the liquid ejection pattern. A hose for mounting over the nozzle may also be provided to further convey the dispensed liquid. In another embodiment, an air horn for mounting over the discharge nozzle is included.

DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
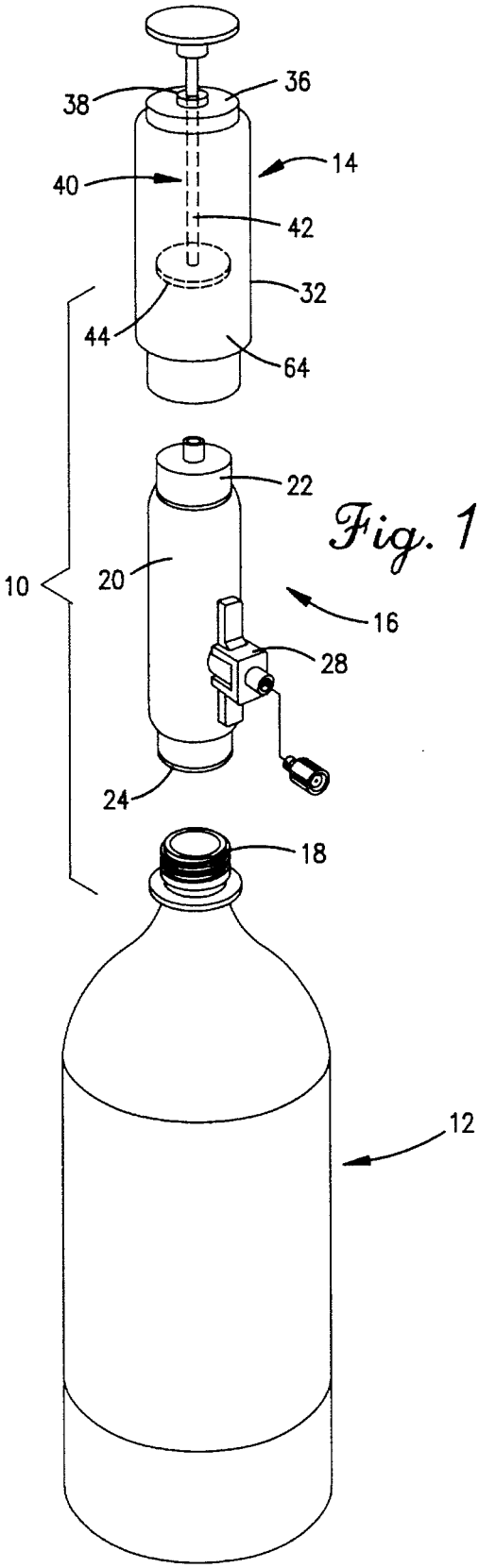
FIG. 1 is a fragmentary exploded perspective view of a liquid spray device according to one embodiment of the present invention shown mounted on an open topped liquid container.
Figure 2:
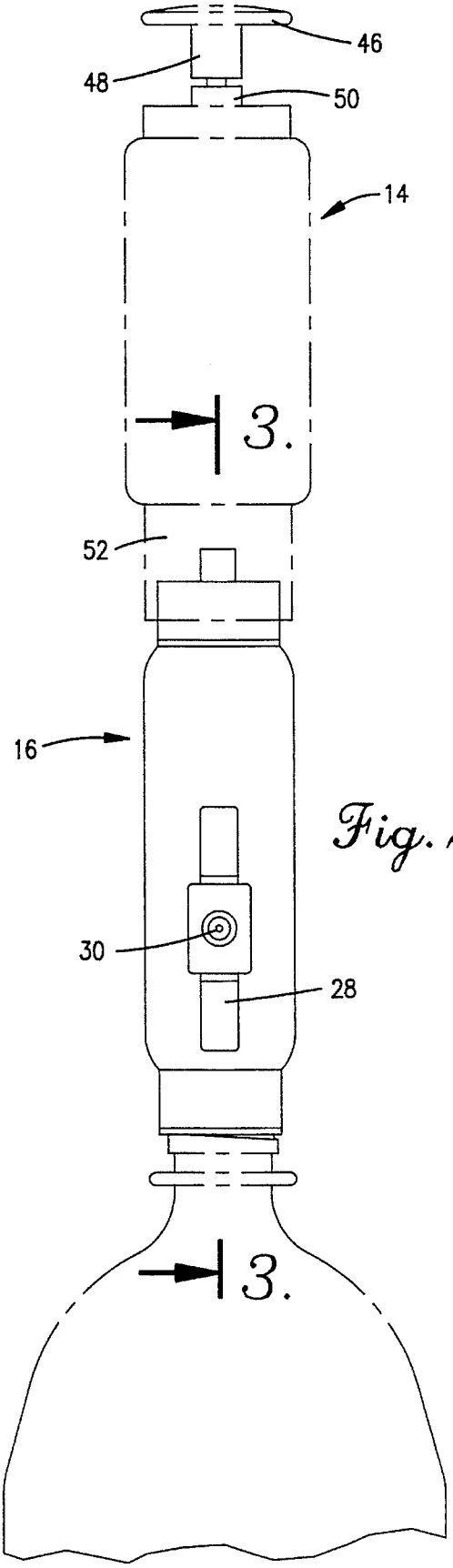
FIG. 2 is an elevational view of the spray device of FIG. 1, wherein the container is fragmentally shown.

Referring to FIGS. 1 and 2, the liquid spray device of the present invention is represented generally by the numeral 10. The liquid spray device is adapted to be conveniently mounted on an open topped liquid container 12. Although the device is suitable for use with any number of container or vessel configurations, it is preferably adapted to be mounted on readily available containers such as those sold commercially with consumable goods. In this manner, the user can find a container with relative ease and little expense. In a preferred embodiment, the device is configured for mounting on a resilient walled readily available container such as a plastic liter soda bottle. These containers are particularly suited for purposes of the present invention because they are reusable, disposable, recyclable, non-breakable and replaceable.

The liquid spray device 10 of the present invention generally comprises an air pump 14 and a spray member 16. The spray member 16 is mountable over the container opening or mouth 18 as a closure. The element 16 comprises a tubular wall 20 having a cap 22 at its top and an open bottom 24. The tubular wall 20 presents a fluid receiving chamber 26 therein which communicates with container 12. The air pump 14 is configured at its bottom to closely receive the top of the spray member 16 so that air exiting the pump can pass into the fluid receiving chamber 26. Side trigger 28 mounted on tubular wall 20 is manually operable to selectively discharge liquid in receiving chamber 26 through the discharge nozzle 30.

The air pump 14 is a manually operable displacement pump generally comprising an elongated cylinder 32 which presents a cylindrical pumping chamber 34 therein. The pumping and fluid receiving chambers are aligned along a common central axis. A top closure 36 is provided having a central opening 38 bored therethrough which opens to pumping chamber 34. A reciprocating plunger 40 is slidably mounted in the cylinder 32. The plunger 40 includes an elongated shaft 42 which extends the length of the pumping chamber and through the central opening 38 at the its top. A rounded flat head 44 is provided on the bottom end of shaft 42 remote from top closure 36. A knob handle 46 having a tubular mounting piece 48 configured to be complimental with shaft 42 so as to receive its uppermost end is thereby mounted on the top of the shaft. A relatively flat ring-shaped member 50 formed on the top closure 36 of pumping chamber 34 encircles central opening 38. Knob handle 46 enables the user to manually reciprocate the plunger 40 upward and downward throughout the length of pumping chamber 34. The plunger 40 is stopped on the down stroke when the bottom surface of the tubular mounting piece 48 contacts the top surface of ring-shaped member 50.

Figure 3:
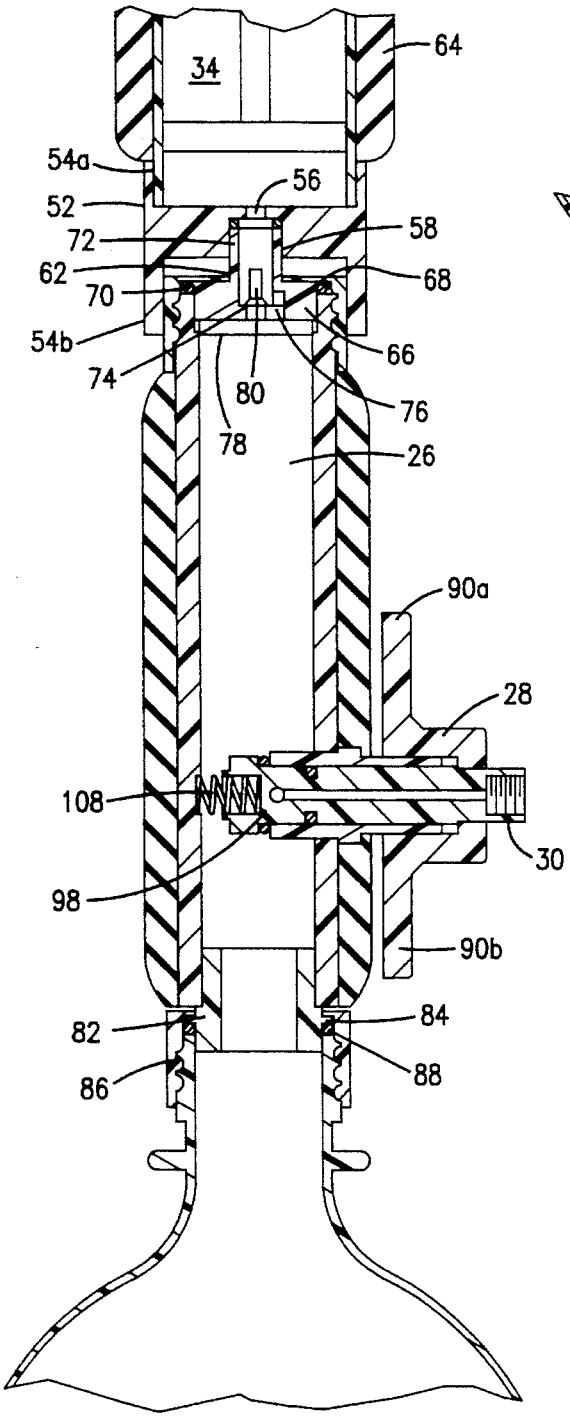
FIG. 3 is a fragmentary sectional view taken generally along line 3—3 of FIG. 2.
Figure 4:
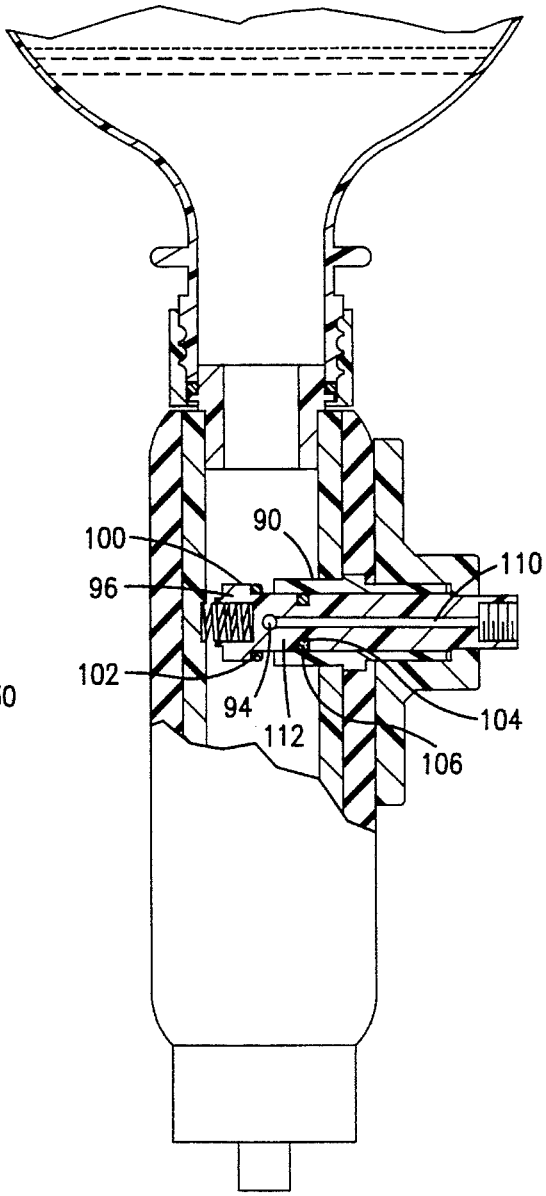
FIG. 4 is a fragmentary partially sectional view taken generally along line 3—3 of FIG. 2, wherein the spray member and container are shown inverted and the side trigger is pressed against the spray member to open the passageway connecting the discharge nozzle and the fluid receiving chamber.

With reference to FIGS. 3 & 4, a rounded adapter base 52 is coupled to the bottom surface of the cylinder walls 32 to enclose the bottom of pumping chamber 34. Sidewalls 54(*a*) extending vertically upward along the outer periphery of base 52 are affixed to the outer surface of the lower cylinder wall 32. The sidewalls 54(*b*) extend vertically downward along the outer periphery of the adapter base 52 and are configured to receive the top of spray member 16. Exhaust port 56 bored through the center of adapter base 52 communicates with pumping chamber 34. A bore tunnel presented continuous with the exhaust port 56 is provided in the bottom surface of the base 52. An outer cover wall 64 is affixed to the outer wall of cylinder 32 along the length of the cylinder.

The component parts of pump 14 may be constructed of any resilient material including metal or plastic and are most preferably injection molded from a plastic material such as polypropylene or polyethylene. In a preferred embodiment the outer cover wall 64 is constructed of a foam or sponge-like material for comfort in use and handling.

The spray member 16 has a tubular wall 20 that presents a fluid receiving chamber 26 therein which is open at its bottom 24 to receive liquid from the container on which it is mounted. The top of the element is covered with a cap 22 having an inlet port 62 bored therethrough. The sidewalls of cap 22 are interiorly threaded for secure engagement with the tubular wall 20 of the spray member. A continuous cover wall 64 is affixed along the outer tubular wall 20.

A relatively flat circular insert 66 is configured to be received within the inner sidewalls of the cap 22. An enlarged collar 68 at the upper end of the insert is adapted to receive O-ring 70 along its bottom surface. The enlarged collar 68 and O-ring 70 are compressed between the bottom surface of cap 22 and the upper surface ends of the tubular wall 20. A hollow tube 72 projecting upward at a vertical angle from the center of the insert 66 is inserted through inlet port 62. The hollow tube 72 is configured to be closely received by the bore tunnel 58 provided in the bottom surface of the pump adapter base 52. A central aperture 74 bored through insert 66 continuous with the opening formed by hollow tube 72 communicates with the fluid receiving chamber 26 in spray member 16. A second aperture in communication with the fluid receiving chamber 26, is provided to one side of central aperture 74 and opens to the interior of hollow tube 72.

A circular flapper 78 made of a resilient rubber-like material abuts the bottom surface of insert 66 and is secured in place by inserting upwardly extending peg 80 through central aperture 74. When the air pump is fitted over spray member 16, air exiting the pump exhaust port 56 flows through hollow tube 72 and second aperture 76 into the fluid receiving chamber 26. The circular flapper 78 covers apertures 76 & 78 provided in the insert 66 to block the outward flow of fluids.

A coupling conduit 82 affixed to the lower interior of tubular wall 20 having a peripheral flange 84 turned outwardly from the conduit is provided between the container and receiving chamber 26. A cap-like mounting element 86 affixed to flange 84 is complimentally threaded for engagement with the threaded container mouth 18 for securely mounting the spray member 16 to the container 12. A conventional annular sealing washer or O-ring 88 engaged between the bottom surface of the flange 84 and the upper end surface of the container mouth 18 provides a liquid tight seal.

Figure 5:
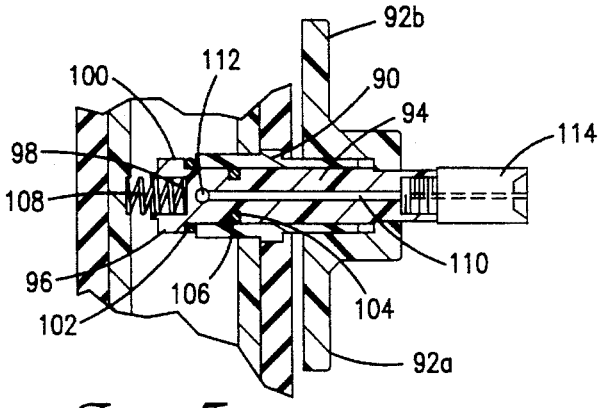
FIG. 5 is a fragmentary elevational view of the spray member showing the mechanism for discharging liquids from the fluid receiving chamber.

Referring to FIG. 5, a cylinder 90 extending from the fluid receiving chamber 26 transversely through the side of tubular wall 20 is secured to the tubular wall. A manually operable side mounted trigger 28 having projections 92(*a*) & 92(*b*) for finger engagement is coupled to a piston body 94 that is slidably received in cylinder 90. A peripheral piston extension wall 96 extending from the end 98 of the piston that is within the receiving chamber 26 includes an outwardly protruding ridge 100. O-ring 102 is affixed to the outer piston wall 94 in contact with the protruding ridge 100 so that O-ring 102 is compressed between the inner end surface of cylinder wall 90 and the protruding ridge 100. An annular groove 104 presented in the outer piston wall and aligned with the tubular wall 20 on which cylinder 90 is affixed, receives O-ring 106. A spring 108 in the fluid receiving chamber 26 adapted to be received within the boundaries of peripheral flange 96 is compressed between piston body end 98 and the interior tubular wall opposing that end. A passageway 110 is bored lengthwise through the piston body 94 extending from discharge nozzle 30 to a lateral passageway 112 provided crosswise through the piston.

With reference to FIGS. 3 & 4, when the trigger 28 is squeezed toward the spray member 16, piston 94 is forced inwardly of fluid receiving chamber 26 to uncover the lateral passageway 112, thus providing a flow path for liquid in receiving chamber 26 to the discharge nozzle 30. When the trigger is released, spring 108 displaces piston 94 back to the outward position thereof as shown in FIG. 3, wherein fluid flow from fluid chamber 26 is blocked.

Figure 6:
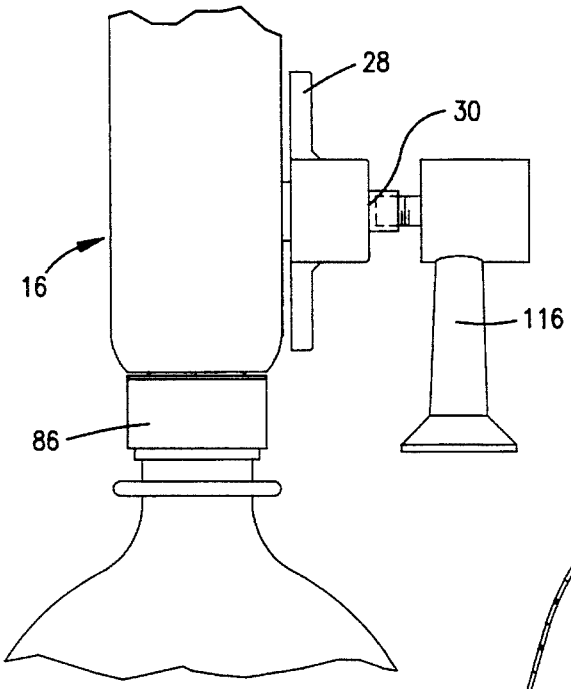
FIG. 6 is a fragmentary elevational view of a dispensing device according to another embodiment of the present invention showing an air horn mounted on the discharge nozzle.

Various attachments may be mounted over discharge nozzle 30. The discharge nozzle 30 is internally threaded to accommodate these attachments. As shown in FIGS. 1 & 5, a dispersal element 114 complimentally threaded on its exterior surface for engagement with the nozzle 30 may be provided to vary the liquid ejection pattern. In another embodiment, a hose or similar tubing press fitted around the exterior of nozzle 30 may be included. With reference to FIG. 6, an air horn 116 is press fitted over the nozzle.

The component parts of the spray member 6 may be constructed of any suitable resilient material including metal or plastic and are most preferably injection molded from a plastic material such as polypropylene or polyethylene. In a preferred embodiment, the outer cover wall 64 of the spray member is constructed of a foam or sponge-like material for comfort in use and handling.

Figure 7:
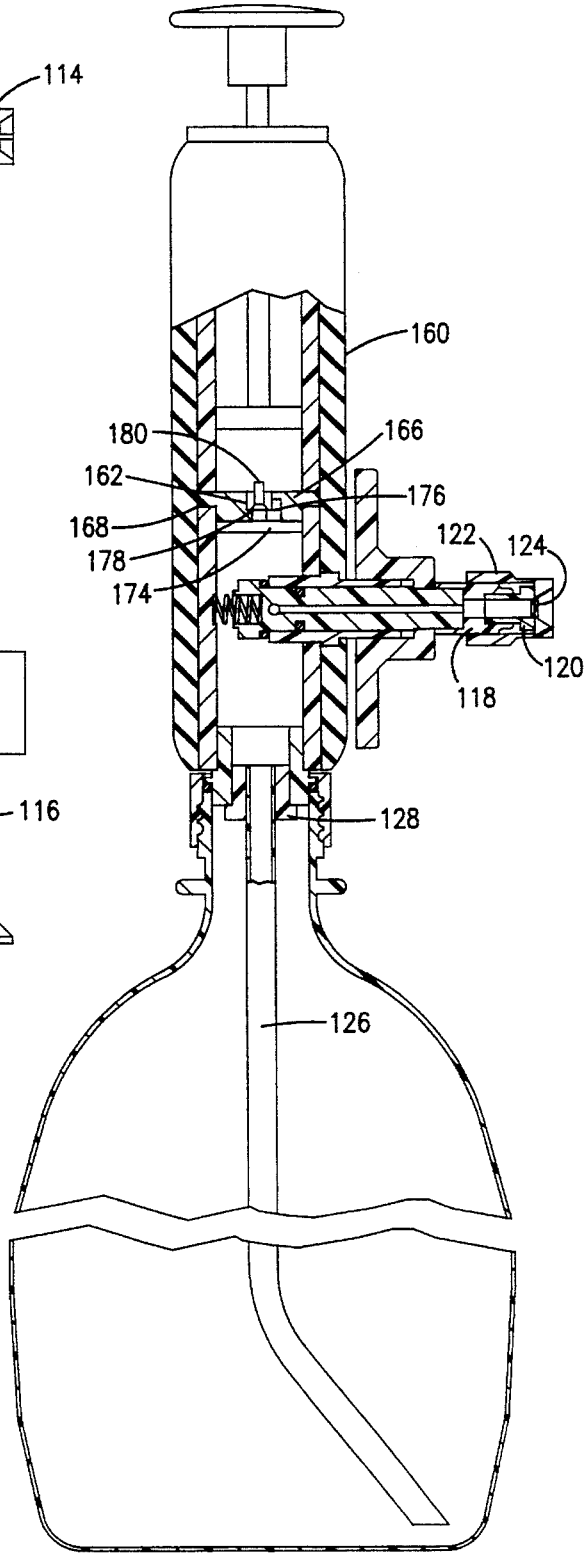
FIG. 7 is a sectional elevational view of another embodiment of the invention, wherein the air pump and the spray member are integrated to form a single component.

A second embodiment of the present invention is shown in FIG. 7. In this embodiment, the air pump 14 and spray member 16 are integrated to form a single component. A rounded insert 166 having an enlarged collar 168 is provided between the bottom of the pumping chamber 34 and the top of fluid receiving chamber 26. The enlarged collar 168 is compressed between the bottom end surface of the pump cylinder walls 32 and the top end surface of the spray member tubular wall 20. A central notch 162 in the top surface of insert 166 communicates with the central aperture 174 bored through the bottom surface of the insert. A second aperture 176 to one side of the central aperture opens to the notch 162. A flapper 178 as previously described abuts the bottom surface of insert 166 and is secured by inserting peg 180 through the central aperture 174. A continuous cover wall 160 is affixed along the outer surface of the pump cylinder 32 and the tubular spray member wall 20.

In another embodiment, the discharge nozzle 30 has a smooth cylindrical exterior surface. Bushing 118 is press fitted over nozzle 30 to protrude from the forward end thereof and is adapted to receive a misting element 120. The misting element 120 projects through bushing 118 so as to abut the inner face of a nozzle cap 122 having a spray orifice 124 therethrough. The nozzle cap 122 is interiorly threaded for engagement with threading on the exterior surface of bushing 118. When the nozzle cap is moved axially to the right to its innermost position, misting element 120 firmly abuts the inner face of cap 122 to produce a fine wide angle spray pattern. The cap is moved axially to the left away from mister 120 to produce a stream pattern.

A further embodiment of the present invention is shown in FIG. 7 wherein tube 128 extends downwardly from the receiving chamber 26 to container 12 so that its open end is positioned near the bottom of the container. Adapter element 128 is affixed to the lower end of coupling conduit 82 that is configured to closely receive the tube in position. Upon building up sufficient pressure in container 12, liquid in the container is forced upward through the tube into the receiving chamber 26.

Figure 8:
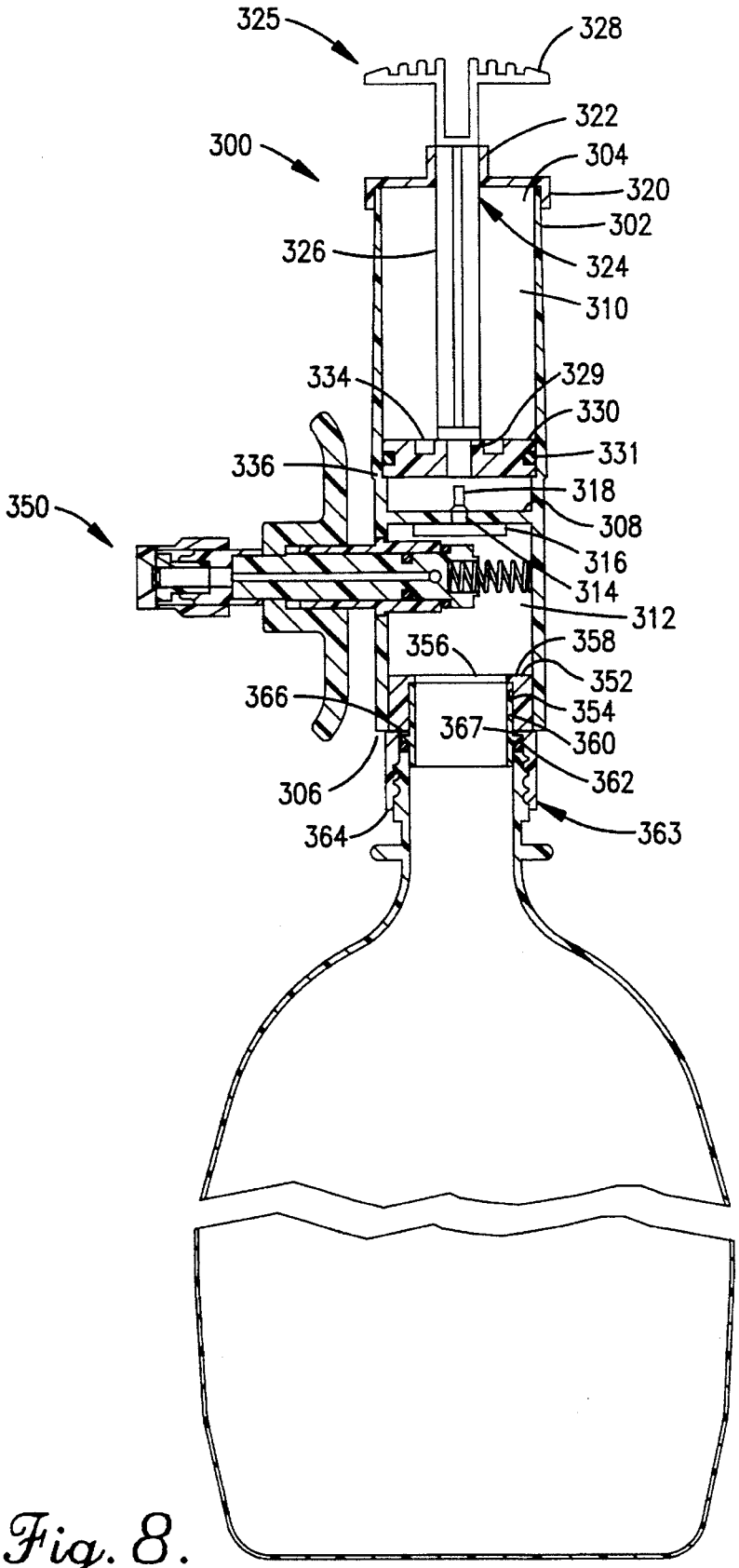
FIG. 8 is a sectional elevational view of another embodiment of the invention, wherein the air pump and spray member are integrated to form a single component. A misting device is mounted over the discharge nozzle, and a transport tube extending into the container is also shown.

FIG. 8 illustrates an alternative embodiment for the liquid spray device 300, in which the pumping and spraying members are formed integrally within a single housing. Particularly, the device 300 includes an integral tubular housing 302 having open top and bottom ends 304 and 306, respectively. A divider 308 is formed integrally with, and at an intermediate point within, the tubular housing 302. The divider 308 separates the housing 302 into a pumping chamber 310 and a fluid receiving chamber 312, respectively. The divider 308 includes an air hole 314 at its center joining the pumping and fluid receiving chambers 310 and 312. An air valve 316, which substantially resembles the flapper 178 of FIG. 7, includes a peg 318 that engages, and projects through, the hole 314 within the divider 308. The air valve 316 operates in the same manner as the above-described flapper 178 to permit air to be forced from the pumping chamber 310 to the fluid receiving chamber 312, while preventing liquid to pass in the opposite direction.

The top end 304 of the housing 302 is received within a cup-shaped end cap 320. The end cap 320 includes a raised circular flange 322 surrounding a hole 324 in the center of the end cap 320. The flange 322 slidingly engages a reciprocating plunger 325 having a pumping rod 326 with a hand grip 328 on one end and a pump piston 330 on the other. The rod 326 is formed with an elongated shaft having a cross-shaped cross-section, to reduce materials, and with a circular lower tip 329 that is sealingly secured within a recess in the pump piston 330. The pump piston 330 includes an O-ring 331 about its perimeter to maintain an air-tight seal during compression strokes, and voids 334 in its backside to reduce further the materials.

Within the pumping chamber 310, the tubular housing includes a lower most region adjacent the divider 308 having a smaller diameter than that of the upper region. The upper and lower regions intersect to form a ridge 336 surrounding the tubular housing 302 which functions as a stop for the piston pump 330 since the diameter of the piston pump 330 is larger than that of the housing lower region near the divider 308. The ridge 336 prevents the piston pump 330 from contacting the peg 318 and inadvertently opening the air valve 316, thereby allowing liquid to flow into the pumping chamber 310. The housing 302 includes a hole in the side thereof opening into the fluid receiving chamber 312 to admit a spraying mechanism 350 which extends radially into the fluid receiving chamber 312. The spraying mechanism 350 substantially resembles that of FIG. 5, and thus the detailed explanation thereof is not repeated.

The bottom end 306 of the housing sealingly receives a retainer adaptor 352 having a recess 354 therein that extends along a majority of the adaptor's length upto a discharge opening 356. The discharge opening 356 is formed within a flange 358 and has a smaller diameter than that of the recess 354. A cap retainer 360 is secured within the recess 354 such that a top end of the cap retainer 360 abuts against the flange 358. The cap retainer 360 includes a rib 362 about its perimeter and at a position proximate the retainers bottom end to form a groove 363 between the rib 362 and the bottom end of the retainer adapter 352 when the top end of the cap retainer 360 mates with the flange 358.

A cap-like mounting element 363 is mounted on the cap retainer 360. The cap-like mounting element 363 has a threaded lower end 364 to engage the threaded container mouth 18 and has an internally projecting rim 366. The rim 366 fits within the groove 363 and is rotated relative to the cap retainer 360 to allow the spray device 300 to be screwed onto the container without rotating the spray device 300. A sealing washer or O-ring is positioned against the bottom side of the rim 366 to seal with the top of the container mouth 18. This adaptor/cap retainer assembly provides a solid supporting and sealing assembly between the container and spray device 300.

As illustrated in FIG. 8, the container and spray device 300 are initially oriented in an upright position, in which the pumping chamber 310 is above the fluid receiving chamber 312, such that the spray device may be attached without loosing liquid. Once attached, the container and spray device 300 are inverted (i.e., turned 180°) to orient the container above the fluid receiving chamber 312 thereby filling the fluid receiving chamber 312 with liquid. While in this inverted or upside down position, pressurized air from the pumping chamber and within the fluid receiving chamber passes to the bottom of the container. The arrangement of the pumping and fluid receiving chambers 310 and 312 separated by a divider 308 allows pressurized air to be introduced into the container while in upright and inverted positions. Thus, the spray device 300 allows the user to "pump up" the device before and after inverting it to a liquid dispensing position. This arrangement further ensures that fluid within the container is completely dispensed.

From the foregoing it will be seen that this invention is one well adapted to attain all ends and objects herein above set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense. For example, other types of air pumps could of course be used, such as multiple cylinder reciprocating pumps, rotary or centrifugal type pumps. The spray member could also conceivably be mounted to cover the opening of the container by any suitable means such as by an interference locking means rather than complimental threading. Other container shapes could also conceivably be accommodated with the appropriately shaped mounting element.

What is claimed is:

1. A liquid spray device for mounting on a container, said device comprising:

a cylindrical pumping chamber;

a reciprocating plunger slidably mounted in said pumping chamber and extending through an opening in a top closure thereof;

a tubular liquid receiving chamber located adjacent a bottom of said pumping chamber and above said container while oriented in an upright position, wherein said liquid receiving chamber includes an open bottom adapted for mounting on said container, said pumping and liquid receiving chambers having a common central axis extending along a length thereof;

divider means for separating said pumping and liquid receiving chambers, a one way valve, proximate said divider means, for allowing only air to pass from said pumping chamber to said liquid receiving chamber; and discharge means including an outer end with a discharge nozzle thereon that is selectively operable to discharge pressurized liquid from said receiving chamber, said discharge means extending through a side wall of, and traversing an interior cross-section of, said liquid receiving chamber at a point intermediate said pumping chamber and the container.

2. A device according to claim 1, wherein said divider includes a central notch in a top surface of said divider which communicates with a first aperture bored through a center of said divider, said notch and said first aperture communicating with said one way valve, said one way valve simultaneously passing air and blocking liquid flow therethrough.

3. A device according to claim 2, wherein said divider further includes a second aperture bored upward from a bottom surface of said divider into communicating relation with said central notch, said one way valve including a centrally located peg fixedly inserted through said first aperture.

4. A device according to claim 1, wherein said discharge means includes a housing cylinder securely mounted to, and extending transversely through, said side wall of said liquid receiving chamber and a piston, having said nozzle on an outer end, slidably mounted within said housing cylinder, a passageway extending through said piston to said discharge nozzle, said passageway being selectively opened to discharge liquid.

5. A device according to claim 1, wherein said discharge means includes a piston slidably mounted in and extending through said side wall of the liquid receiving chamber and means for biasing said piston outward with respect to said side wall to a shut position, said piston admitting liquid therethrough when in an open position, said piston and biasing means traversing said liquid receiving chamber.

6. A device according to claim 5, wherein said discharge means includes a piston slidably mounted in a cylinder mounted in a hole in said side wall of the liquid receiving chamber and means for biasing said piston outward with respect to said cylinder to a shut position, said piston admitting liquid therethrough when in an open position, said piston and biasing means traversing said liquid receiving chamber, wherein said biasing means including a spring secured between a rear end of said piston and a wall of said receiving chamber opposite to said hole in said side wall.

7. A liquid spray device for mounting on a container, said spray device comprising:

a tubular housing having a pumping chamber and a fluid receiving chamber separated by a divider having first and second apertures bored therein, said housing having a bottom end, with respect to an upright position, proximate said fluid receiving chamber for receiving said container and having a top end proximate said pumping chamber;

pumping means received within said top end and extending into said pumping chamber for producing pressurized air; and valve means, fixedly secured within and extending through said first aperture into said pumping chamber, for passing said pressurized air from said pumping chamber to said fluid receiving chamber and for simultaneously preventing a flow of liquid from said fluid receiving chamber to said pumping chamber when said housing and said container are positioned in an inverted upside down position with respect to said upright position; and spraying means, extending through a side wall of said fluid receiving chamber and into an interior of said fluid receiving chamber, to discharge selectively said fluid from said fluid receiving chamber, said spraying means including a piston extending transversely from said fluid receiving chamber to a discharge nozzle and having a passageway therethrough which is selectively opened for discharging liquid when in said upside down position, said piston being normally biased outward to close said passage by a spring traversing said liquid receiving chamber.

8. A liquid spray device according to claim 7, wherein pumping and fluid receiving chambers and said divider are integrally formed with one another and wherein said tubular housing includes integral safety means, within said pumping chamber for preventing said pumping means from contacting said valve means.

9. A liquid spray device according to claim 7, wherein said pumping means includes a reciprocating plunger and said housing includes an integral inner ridge, within said pumping chamber near said divider, to prevent said plunger from contacting said valve means and releasing fluid into said pumping chamber.

10. A device according to claim 7, wherein said housing comprises:

an elongated cylinder forming said pumping chamber;

a bottom closure receiving said container; and a top closure having an opening in communication with said pumping chamber; and wherein said pumping means comprises:

a reciprocating plunger, within said pumping means, slidably mounted in said pumping chamber and extending through said top closure.

11. A device according to claim 7, wherein said container is a disposable plastic soda bottle.

12. A liquid spray device according to claim 7, further comprising:

a retainer adapter, received within said bottom end of said housing, having a recess in a bottom end thereof and a hole surrounded by a flange on a top end thereof to support said container and to permit fluid to pass therethrough while in said upside down position.

13. A device according to claim 7, wherein said device additionally includes an air horn mounted on a discharge nozzle of said spray means.

14. A device according to claim 7, wherein said spraying means includes a sprayer attachment mounted on a discharge nozzle of said spray means to vary a liquid ejection pattern.

15. A device according to claim 7, wherein said device additionally includes a hose mounted on a discharge nozzle of said spraying means.

16. A liquid spray device according to claim 7, wherein said divider includes a central notch in a top surface of said divider which communicates with said first aperture bored through said divider, said notch and said first and second apertures communicating with a valve included as part of said valve means, said valve means simultaneously passing air and blocking liquid flow.

17. A liquid spray device according to claim 16, wherein said second aperture is bored upward from a bottom surface of said divider into communicating relation with said central notch, said valve means including a centrally located peg fixedly inserted through said first aperture.

18. A method for using a liquid spray device, having a pumping chamber and a fluid receiving chamber aligned immediately adjacent one another along a common central axis, said pumping chamber including a reciprocating plunger, said spray device being mounted on a container holding liquid, said method comprising the steps of:

mounting a bottom end of said pumping and fluid receiving chambers upon a top opening of said container when said spray device and container are in a substantially upright position such that said pumping and fluid receiving chambers are aligned along common central axis which passes through a center of said top opening;

introducing pressurized air into said container from said pumping chamber through said fluid receiving chamber by moving said reciprocating plunger along said central axis in a direction toward said fluid receiving chamber and said top opening of said container;

inverting said spray device and said container to an upside down liquid dispensing position wherein said container is inverted and positioned directly above said fluid receiving chamber to utilize gravity to deliver liquid from said container to said fluid receiving chamber; and discharging pressurized liquid from said fluid receiving chamber while said spray device is inverted.

19. A method for using a liquid spray device, according to claim 18, including the steps of:

allowing air to pass from said pumping chamber to said fluid receiving chamber, while in both of said upright and upside down positions; and preventing liquid from passing from said fluid receiving chamber to said pumping chamber, while in both of said upright and upside down positions and while air passes from pumping chamber to said liquid receiving chamber.

20. A method for using a liquid spray device, according to claim 18, wherein said introducing step includes the sub-step of:

pumping said reciprocating plunger within said pumping chamber to force air from said pumping chamber through a one-way valve into said fluid receiving chamber.

21. A method for using a liquid spray device, according to claim 20, further including the step of:

stopping said plunger, during a compression stroke, from contacting and interfering with said one way valve between said pumping and fluid receiving chambers, thereby preventing fluid from passing from said fluid receiving chamber to said pumping chamber.

22. A method for using a liquid spray device, according to claim 18, wherein said discharging step further comprising the step of:

grasping an exterior wall of said pumping chamber and fluid receiving chamber proximate discharge means for discharging liquid and squeezing said discharge means, while said container and said spray device are in an upside down position.

23. A method for using a liquid spray device, according to claim 18, further comprising the step of:

arranging said pumping chamber integrally with said fluid receiving chamber immediately adjacent each other, separated by a divider formed integral with a housing of said spray device, said pumping chamber being positioned above said fluid receiving chamber when in said upright position and being positioned below said fluid receiving chamber when in said upside down position.

24. A liquid spray device for mounting on a container, said spray device comprising:

a tubular housing having a pumping chamber and a fluid receiving chamber separated by a divider formed integral with said housing, said housing having a bottom end, with respect to an upright position, proximate said fluid receiving chamber for receiving said container and having a top end proximate said pumping chamber;

pumping means received within said top end and extending into said pumping chamber for producing pressurized air;

valve means received by said divider for permitting said pressurized air to pass from said pumping chamber to said fluid receiving chamber and for preventing a flow of liquid from said fluid receiving chamber to said pumping chamber when said housing and container are positioned in an upside down position inverted with respect to said upright position;

spraying means, extending through a side of said housing and into said fluid receiving chamber, to discharge selectively said fluid; and said device additionally includes an air horn mounted on a discharge nozzle of said spray means.

25. A liquid spray device for mounting on a container, said spray device comprising:

a tubular housing having a pumping chamber and a fluid receiving chamber separated by a divider formed integral with said housing, said housing having a bottom end, with respect to an upright position, proximate said fluid receiving chamber for receiving said container and having a top end proximate said pumping chamber;

pumping means received within said top end and extending into said pumping chamber for producing pressurized air;

valve means received by said divider for permitting said pressurized air to pass from said pumping chamber to said fluid receiving chamber and for preventing a flow of liquid from said fluid receiving chamber to said pumping chamber when said housing and container are positioned in an upside down position inverted with respect to said upright position;

spraying means, extending through a side of said housing and into said fluid receiving chamber, to discharge selectively said fluid; and a retainer adapter, received within said bottom end of said housing, having a recess in a bottom end thereof and a hole surrounded by a flange on a top end thereof to support said container and to permit fluid to pass therethrough while in said upside down position.

26. A liquid spray device according to claim 25, further comprising:

a cap retainer received within said retainer adapter having a hole therethrough and a rib on an outer side thereof and located proximate a bottom end of said cap retainer such that a groove is formed between said rib and said bottom end of said retainer adapter; and a mounting member for receiving said container and having a rim on a top edge, said rim being rotatably received within said groove, said cap retainer and said mounting member supporting said container and permitting fluid to pass therethrough while in said upside down position.

* * * * *